US012342944B2

(12) United States Patent
DuFresne

(10) Patent No.: US 12,342,944 B2
(45) **Date of Patent: *Jul. 1, 2025**

(54) SEAT CONFIGURATION

(71) Applicant: Anthro Form, LLC, Waukesha, WI (US)

(72) Inventor: Steven DuFresne, Hartland, WI (US)

(73) Assignee: Anthro Form. LLC, Waukesha, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/460,225

(22) Filed: Sep. 1, 2023

(65) Prior Publication Data

US 2023/0414002 A1 Dec. 28, 2023

Related U.S. Application Data

(63) Continuation of application No. 17/848,688, filed on Jun. 24, 2022, now Pat. No. 11,744,375.

(60) Provisional application No. 63/221,669, filed on Jul. 14, 2021.

(51) Int. Cl.

| | |
|---|---|
| ***A47C 7/02*** | (2006.01) |
| ***A47C 7/18*** | (2006.01) |
| ***A47C 7/20*** | (2006.01) |
| ***A47C 7/46*** | (2006.01) |

(52) U.S. Cl.

CPC ..... *A47C 7/46* (2013.01); *A47C 7/029* (2018.08); *A47C 7/18* (2013.01); *A47C 7/20* (2013.01)

(58) Field of Classification Search

CPC ..... A47C 7/44; A47C 7/46; A47C 7/029

USPC ..... 297/284.4, 452.21–452.26, 452.56, 297/452.29–452.3, 452.32–452.35

See application file for complete search history.

(56) References Cited

U.S. PATENT DOCUMENTS 2,970,638 A * 2/1961 Halter ..... A47C 7/029 297/452.25 X
3,059,971 A * 10/1962 Becker ..... A47C 1/023 297/353
3,393,012 A * 7/1968 Chancellor, Jr. ..... A47C 7/34 5/654.1
3,778,104 A * 12/1973 Kusters ..... B60N 2/686 297/452.21 X (Continued)

OTHER PUBLICATIONS

Le Huec JC, Aunoble S, Philippe L, Nicolas P., Pelvic Parameters: Origin and Significance, European Spine Journal, Sep. 2011, 20 Suppl 5(Suppl 5):564-71, Epub Aug. 10, 2011, doi: 10.1007/s00586-011-1940-1.

(Continued)

*Primary Examiner* — Rodney B White
(74) *Attorney, Agent, or Firm* — Boardman & Clark LLP

(57) ABSTRACT

A seating configuration is described. The seating configuration includes a first support surface configured to support the Ischial Tuberosities of a user. The first support surface includes a feature to urge a user into an optimal position on the seat. The seating configuration includes a second support surface positioned adjacent a pelvic-sacral-lumbar region of the user. The seating configuration includes a third support surface positioned adjacent a thoracic-cervical region of the user. The first, second, and third support surfaces, respectively, together can be configured to create a natural alignment of a spinal column of the user.

18 Claims, 13 Drawing Sheets

(56) References Cited

U.S. PATENT DOCUMENTS 4,607,882 A * 8/1986 Opsvik ..... A47C 9/002 297/452.25 X
D320,120 S 9/1991 Samuelsson
5,112,106 A * 5/1992 Asbjornsen ..... A47C 7/46 297/284.7
5,352,023 A * 10/1994 Jay ..... A61G 5/125 297/452.26 X
5,395,162 A * 3/1995 Jay ..... A47C 7/021 297/452.25 X
5,457,833 A * 10/1995 Jay ..... A61G 5/1091 297/452.25 X
5,501,507 A * 3/1996 Hummitzsch ..... A47C 7/46 297/284.4 X
5,513,899 A * 5/1996 Michaels ..... A47C 31/126 297/452.25 X
5,887,951 A * 3/1999 Willingham ..... A47C 7/029 297/452.23 X
5,950,263 A * 9/1999 Hanson ..... A61G 5/1045 297/452.25 X
6,123,390 A * 9/2000 Greenwald ..... A47C 7/46 297/452.25 X
6,394,547 B1 * 5/2002 Vik ..... A47C 7/46 297/423.26
6,811,218 B2 * 11/2004 Deimen ..... A47C 7/029 297/452.25 X
6,938,956 B1 * 9/2005 Piretti ..... A47C 7/38 297/284.7
D512,231 S 12/2005 Landin Lorentzen
7,040,703 B2 * 5/2006 Sanchez ..... A47C 7/405 297/284.4
7,140,057 B2 * 11/2006 Hetzel ..... A61G 5/1043 297/452.26 X
7,216,388 B2 * 5/2007 Bieganek ..... A47C 7/029 297/452.28 X
7,303,232 B1 * 12/2007 Chen ..... A47C 7/38 297/284.7
7,396,082 B2 * 7/2008 Sanchez ..... A47C 7/405 297/284.4
7,625,046 B2 * 12/2009 Sanchez ..... A47C 7/402 297/284.4 X
8,449,037 B2 * 5/2013 Behar ..... A47C 7/46 297/284.4 X
8,602,493 B1 * 12/2013 Chen ..... A47C 7/029 297/452.23 X
8,671,482 B2 * 3/2014 Willingham ..... A47C 9/002 297/452.21
8,864,230 B2 * 10/2014 Augustat ..... A47C 3/20 297/383
8,926,016 B2 * 1/2015 Behar ..... A47C 5/12 297/284.4 X
9,021,637 B1 * 5/2015 Whelan ..... A61G 7/057 297/452.25 X
9,326,613 B2 * 5/2016 Cvek ..... A47C 7/02
9,480,340 B1 * 11/2016 Harlow ..... A47C 7/46
D804,879 S 12/2017 Harlow
10,264,890 B2 * 4/2019 Aldrich ..... A47C 7/462
10,272,282 B2 * 4/2019 Harlow ..... A47C 7/746
10,477,973 B2 * 11/2019 Gerbino ..... A47C 7/462
10,827,841 B1 * 11/2020 Tsai ..... A47C 7/405
11,744,375 B2 * 9/2023 DuFresne ..... A47C 1/023 297/284.3
11,857,471 B2 * 1/2024 Peyton ..... A47C 7/18
2005/0189810 A1 * 9/2005 Wu ..... A47C 7/40 297/452.29
2009/0146476 A1 * 6/2009 Kan ..... A47C 7/46 297/284.4
2012/0119560 A1 * 5/2012 Wu ..... A47C 7/029 297/452.21
2012/0193959 A1 * 8/2012 Chen ..... A47C 7/38 297/301.1
2015/0015042 A1 * 1/2015 Willingham ..... A47C 7/144 297/452.21 X
2016/0360889 A1 * 12/2016 Matlin ..... A47C 7/46
2021/0085083 A1 * 3/2021 Beech ..... A47C 3/026

OTHER PUBLICATIONS

Roussouly P., Pinheiro-Franco J.L., Sagittal Parameters of the Spine: Biomechanical Approach, European Spine Journal, Sep. 2011, 20 Suppl 5(Suppl 5):578-85, Epub Jul. 28, 2011, doi: 10.1007/s00586-011-1924-1.

Park KN, Kim SH, The Effect of a Pelvic Support Chair on Sagittal Lumbosacral Alignment in Sitting Position in Patients with Lower Back Pain, Iran Journal of Public Health, Sep. 2022, 51(9):2069-2077. doi: 10.18502/ijph.v51i9.10562.

Alvin R. Tilley, Henry Dreyfuss Associates, Stephen B. Wilcox. The Measure of Man and Woman: Human Factors in Design. New York: Wiley, 2002.

Lee LJ, Chang AT, Coppieters MW, Hodges PW, Changes in Sitting Posture Induce Multiplanar Changes in Chest Wall Shape and Motion with Breathing, Respiratory Physiology & Neurobiology, Mar. 31, 2010,170(3):236-45, Epub Jan. 18, 2010, doi: 10.1016/j.resp.2010.01.001, Epub Jan. 18, 2010.

Minkel, Jean L. "Seating and mobility evaluations for persons with long-term disabilities: Focusing on the client assessment." Seating and Wheeled Mobility. Routledge, 2024. 3-26.

https://www.youtube.com/watch?v=GKtGJzpU8H8, Sep. 27, 2023.

Cleveland Clinic "Lumbar Spine" https://web.archive.org/web/20240916150821/https://my.clevelandclinic.org/health/articles/22396-lumbar-spine, Feb. 17, 2022.

* cited by examiner

SEAT CONFIGURATION

CROSS-REFERENCE TO RELATED APPLICATIONS

This application is a continuation of U.S. Non-Provisional application Ser. No. 17/848,688, now U.S. Pat. No. 11,744,375, filed Jun. 24, 2022, entitled "SEAT CONFIGURATION;" which claims the benefit of U.S. Provisional Patent Application No. 63/221,669 filed Jul. 14, 2021, entitled "SEAT AND BACK FOR A CHAIR", the entire contents of each of which are hereby incorporated by reference herein in their entirety.

BACKGROUND

Proper posture is not only important for the spine, but also the pelvic region and shoulders. Sitting without proper posture repeatedly and for long periods of time can eventually lead to chronic back pain, shoulder and neck pain, or even permanent or semi-permanent misalignment of the spine, which may require medical intervention to correct. Additionally, sitting in a hunched over position can affect a person's breathing.

A majority of people work in an office job or another job that requires sitting upright in a chair or seat for extended periods of time, often for more than 8 hours in a single day. Typical seating used by people of all sizes does not adjust to fit each individual's unique sitting needs anthropometrically, biomechanically, or at the general comfort level. General comfort is often tough to quantify but it is common medical knowledge that pain from tissue, joint, muscle, etc. is simply derived from a person's nociceptors. The nociceptor that determines pain in the seated space is known as the mechanoreceptors. The four main types of mechanoreceptors are the Merkel disks for the pressure, the Ruffini corpuscles for the stretch and shear stresses, the Pacinian corpuscles for vibration, and the Meissner's corpuscles primarily providing information about tactile and sensitive changes. The Merkel disks and the Ruffini corpuscles mechanoreceptors are slowly adapting cutaneous mechanoreceptors. For comfort, slowly adapting mechanoreceptors are more critical than fast adapting mechanoreceptors. Therefore, parameters in the interaction zone that may be relevant to comfort are pressure elongation and shear stress. These findings were not published until 2005 and were not examined as relevant to seating comfort until 2020. Thus, previous chair designs trying to apply posterior lifting features to the pelvic and thoracic regions did not take into account that the forces from the back supports were creating an equal and opposite shear force across the seat of the occupant and impacting Ruffini corpuscles.

For example, in U.S. Pat. Nos. 7,040,703, 7,396,082, and 4,981,325, each device tries to apply a force to the sacral and thoracic regions, but do not attempt to counteract that force. This will lead to the pelvis of the occupant sliding forward over time, resulting in an unstable posture, and/or will lead to discomfort caused by a reaction of the Ruffini corpuscles.

Nociceptors are located in the skin, muscles, skeletal structures, and viscera and are responsible for sending pain signals to the brain for a person to process and then take appropriate action. If a chair doesn't fit a user properly, the user may sit awkwardly causing tissue or joint pain. Additionally, the tissue or joint pain often causes the user to move or fidget in the chair. If a chair can adjust to truly fit the size and shape of the user, exert low peak pressure and low shear on the tissue surfaces, and hold the user's pelvis, spine, and head in a neutral posture alignment, the user may experience less pain while sitting, thus achieving greater comfort over time. This is not an easy task, and a solution is desired to achieve the above-mentioned steps for increased comfort over time and improved sitting capabilities or tolerances.

In the state of the art of biomechanical laws for sitting and standing, neutralizing one's pelvis in space will result in establishing a natural lumbar curve and alignment of the mid/upper thoracic region. Applying a force or device directly to L1-L4 does not provide biomechanical advantage in lifting the upper thoracic region and/or have the preferred ability to rotate the pelvis into a neutral state. It can be hard for the human body to tolerate the pressure on the L1-L4 that would be required to lift one's central mass using a lumbar support. Supporting/rotating the pelvis gives a user the biomechanical advantage to rotate the pelvis about its natural pivot point, which is the acetabulum (e.g., socket for femoral head). What is known as natural lumbar curvature can more easily be achieved by simply controlling the angle of one's pelvis. When a person is standing or sitting with correct posture/alignment, the pelvis should be within three degrees of neutrality in a posterior/anterior rotation. The human pelvis when standing and measured between the PSIS and ASIS has a balanced/neutral axis of 7 to 10 degrees. Meaning that the pelvis can travel plus or minus 1.5 degrees (i.e., 1.5 degrees in an anterior direction or 1.5 degrees in a posterior direction) before being defined as coming out of neutrality. When in a neutral (or optimal position), the L5, which is firmly held in place to the pelvis with the iliolumbar ligaments, is stacked upright which also allows the L4, L3, L2, and L1 to have an optimal lumbar curve. As an example, when the pelvis begins to rock forward or backwards, the movement of the pelvis holding L5 causes L4, L3, L2, and L1 to sway out of place. Thus, when the pelvis has a posterior rotation, for example in a slouching posture, the person loses their lumbar curve due to the backwards rotation of the L5 within the pelvis, thereby toppling the other lumbar segments. Angling the pelvis too far in the anterior direction results in excessive lordotic posture and angling the pelvis too far in the posterior direction results in slumped or c-shaped sitting. In lordotic posture, there is typically no disc bulging. However, in slumped posture, the disc pressure increases, resulting in bulging of the discs. This is why keeping a neutral pelvis is seen medically as an optimal outcome for long term healthy sitting. This neutrality is what holds L5 at a certain angle in space. L4-L1 follow this arcuate path establishing natural lumbar curve, giving proper disc spacing. When you rotate the pelvis anteriorly or posteriorly, the angles of L5 and L4 follow the rotation of the pelvis because L5 and L4 have so many surrounding ligaments tying them to the pelvis. Thus, when the angles of L5 and L4 change, the natural hinging between L3, L2, and L1 starts reducing or inducing curvature. The further you rotate the pelvis backwards/posteriorly, the more you lose your natural lumbar curvature. It should be made clear that the pelvis's rotational position in space is what controls flexion or extension of the lumbar spine region, which in turn affects intradiscal pressure. Passive extension of the spine on the posterior side causes intradiscal pressure, this leads the nucleus pulposus to migrate anteriorly and thus relieve pressure on pain sensitive structures of the spine including the posterior longitudinal ligament and annulus fibrosis. Thus, controlling one's posture by articulating the pelvis rotation in space is the preferred medical approach to establishing and supporting a natural lumbar and thoracic curve and proper intradiscal pressure.

It should be made clear that if the pelvis is not held in a neutral state, it is biomechanically impossible to restore natural spinal column alignment throughout the entire spine. This is why holding the pelvis in a neutral state during sitting or standing is the only way to stand or sit without adding disc pressures, stress, muscle imbalance and/or fatigue, and joint pain to the entire trunk of the human body.

SUMMARY

A seating configuration is described. The seating configuration includes a seat. The seat includes a feature to retain a user in a specific position on the seat. The seating configuration includes a first back support. The first back support is positioned adjacent a posterior pelvic area of the user. The seating configuration includes a second back support. The second back support is positioned adjacent to the thoracic area of the user. The seat, the first back support, and the second back support together can be configured to create a natural alignment of a spinal column of the user.

BRIEF DESCRIPTION OF THE DRAWINGS

Various examples of embodiments of the systems, devices, and methods according to this invention will be described in detail, with reference to the following figures.

It should be understood that the drawings are not necessarily to scale. In certain instances, details that are not necessary to the understanding of the invention or render other details difficult to perceive may have been omitted. It should be understood, of course, that the invention is not necessarily limited to the particular embodiments illustrated herein.

DETAILED DESCRIPTION OF THE DRAWINGS

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Figure 1:
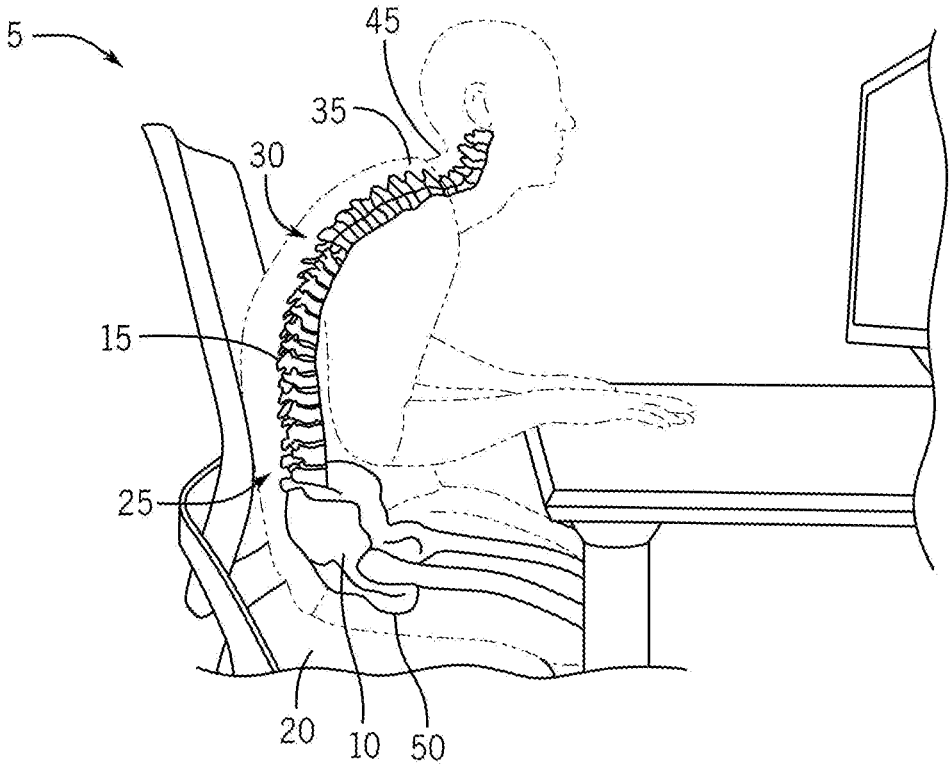
(PRIOR ART) FIG. 1
FIG. 1 depicts a prior art seat in which the user is not prompted to sit in an ergonomic position.
Figure 2:
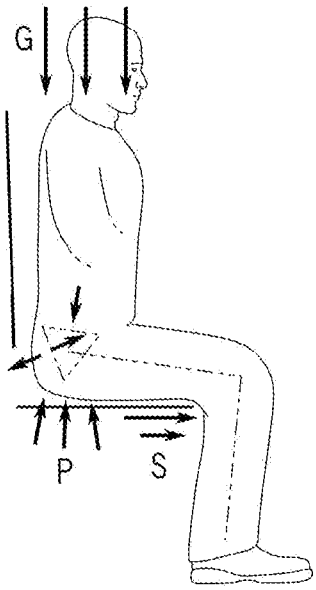
(PRIOR ART) FIG. 2
FIG. 2 depicts a representation of the forces acting on a user while sitting.

FIG. 1 is a representation of a user's typical seated posture in an existing chair 5 that does not have features (e.g., support surfaces) that are capable of properly supporting a person and promote a proper seated posture of the person. FIG. 2 depicts a representation of the forces acting on a user while sitting. The existing chair 5 is depicted as a standard chair, but may instead be another type of seating, such as but not limited to an office chair, airplane seating, vehicle seating, industrial equipment seating, stadium seating, theater seating, residential seating, etc. As shown in FIG. 1, the depicted standard chair does not promote proper alignment of the pelvis (e.g., pelvic-sacral-lumber region) 10 and spine 15 of the user. Proper alignment of the pelvic-sacral-lumbar region 10 and spinal column 15 can be seen when the pelvis 10 is aligned within three degrees of a neutral position (i.e., plus or minus 1.5 degrees in each direction). The proper alignment of the pelvic-sacral-lumbar 10 region and the spine 15 creates proper disc spacing. Improper disc spacing can cause an endless amount of negative health effects. To prevent the negative health effects of improper alignment and disc spacing while sitting, it is important that a person is able to have the pelvis 10 and entire spinal column 15 (i.e., from lumbar to cervical segments) aligned within three degrees of a neutral position when sitting (e.g., in a chair, in a vehicle, on other furniture types, etc.). When the pelvis 10 is in a neutral state while sitting, the ITs are exerting the highest peak pressures (which cause the Merkel disc mechanoreceptors to fire pain signals) through tissue between the bone and a seating surface 20 of the chair 5. In order to allow the user to sit with proper spine alignment, the peak pressures on a user's ITs must be below a tolerable threshold that do not cause the Merkel pain receptor to fire. Studies have shown that the preferred peak pressure threshold is lower than 124 mmHg. Other studies have indicated that when shear stress is present, thus affecting the Ruffini corpuscles mechanoreceptors, the threshold is reduced to 65 mmHg. A comfortable pressure with no shear was recorded at 87 mmHg and when shear was introduced, the comfortable pressure tolerance lowered to 64 mmHg. Thus, reducing both peak pressure and shear stress in the seated plane is critical for improving sitting comfort over time. FIG. 2 depicts a representation of the forces acting on a user while sitting. The forces include gravity (G), pressure (e.g., the peak pressures on the IT's) (P), and shear stress (S). Additionally, the pelvic tilt affects the posture of the user and should be accounted for. A slumped thoracic region also causes an additional downward angled force that should be counteracted.

Additionally, the seat typically has minimal or no support characteristics to hold the inferior surface of one's pelvis 10 laterally and typically also lacks features to prevent shearing on the anterior side of the Ischial Tuberosities (IT's), which reduces sliding of the pelvic area forward and backward. This lack of support results in pelvic collapse and typically leads to the user being in slumped or slouched forward seating position. In addition, a user will unknowingly lean side to side in an attempt to avoid discomfort within their sit bones and/or their spinal column. Leaning and/or fidgeting is a side effect of feedback from the mechanoreceptors (i.e., the Merkel disc and the Ruffini corpuscles) that indicates discomfort or soreness while sitting. If a user's sit bones (IT's) are sore, they may also tend to perch on the front edge of the chair to help alleviate this soreness, which ultimately was caused by high peak pressures on their sit bones. Perching on the edge of the chair may provide temporary relief by lowering the distal end of the user's femurs, thus lifting their pelvis 10. This perching behavior to avoid sit bone pain pulls the user away from any back support feature that could help them sit upright with ease. With no back support, the body will fatigue quickly due to the large amount of muscle groups that need to be activated in order to hold the user in a pelvic/spine neutral position. This is not optimal or comfortable sitting behavior for 6 to 8 hours a day.

As shown in FIG. 1, in a typical seating position, the pelvis 10 of the user is tipped back instead of in a natural, neutral alignment. The back support of the chair depicted in FIG. 1 is substantially flat and/or not curved in the proper alignment to prevent lower back pain. Alternatively, in a chair with a lumbar support, the lumbar support is expected to lift both the upper thoracic region 30 as well as pelvic-sacral-lumbar region 10 by applying pressure to the smallest cross-section of the skeletal regions (i.e., the lumbar region 25, specifically L1-L4) associated with upper body alignment. Biomechanically speaking, it is not optimal to apply so much pressure to such a weak/small section of the spine 15. The pressure on the lumbar region 25 of the spine caused by traditional lumbar supports often results in a feeling of acute pressure/lift in the user, triggering a mechanoreceptor response and ultimately causing the user to fidget due to the discomfort. While some chairs 5 try to force the lumbar region 25 into the proper curve, the users of these chairs 5 often still slump forward for comfort or due to core muscle fatigue, rendering any lumbar support ineffective. A study of lumbar supports found that in order to maintain lumbar lordosis in sitting, a lumbar pad would need to be 9 cm thick, however, participants tended to complain that such a thick lumbar pad pushed their body too far forward, thus resulting in a center of pressure (CoP) that was more anteriorly located on the seat pan. The center of pressure being more anteriorly located resulted in an increase of shear stress through the seated plane, thus reducing comfort and causing the Ruffini receptors to fire.

Moving to the thoracic region 30 of the spine 15, in a normal user's seated posture, as depicted in FIG. 1, the thoracic-cervical region 30 is rounded forward. Without proper pelvis alignment, a user must engage the abdominal, back, neck, and shoulder muscles to maintain proper posture in the thoracic-cervical region 30. Most users are unable to do this for the extended lengths of time often required while in a typical task or resting position within a chair. The majority of people sit for 8+ hours a day for their jobs, many of those people sitting at a desk. The resulting rounding of the thoracic region 30 can lead to back pain or other health problems from repeated and extended positioning in this way.

Furthermore, most users keep their shoulders 35 in a forward position because the thoracic-cervical region 30 is not properly supported around the T10-T12 segments of the spine 15 by the back support of the example chair in FIG. 1. This lack of support causes the upper thoracic region 30 to have an anterior lean, thus allowing the shoulders 35 to rotate forward and the cervical region and head to fall forward. The slumped forward thoracic region 30, shoulders 35, and neck 45 may lead to pain and soreness in the muscle groups from the sternum through the shoulders and neck.

In addition to the muscle strain and fatigue in the back, shoulders 35 and neck 45, a typical chair 5 also causes excess pressure on the ischial tuberosity 50 (may colloquially be referred to as sit bones). The seat 20 of the chair 5 may also cause shear pain directly beneath and/or on the anterior side of the ischial tuberosities 50 within the tissue, muscle, and fat that is compressed between the seat surface and ischial tuberosities. This shear pain (i.e., response from the Ruffini corpuscles mechanoreceptors) is induced when a user is sliding in a seated plane; not only is this uncomfortable, it is also dangerous and reduces blood flow, which destroys one's cells more quickly than pressure alone (i.e., a response from the Merkel disc mechanoreceptors). Shear within a seating system will also trigger a nociceptive pain signal more abruptly than pain or discomfort caused by pressure. Pressure pain and/or shear pain will cause the user to frequently re-adjust to find a more comfortable sitting position regardless of how optimal a back support may be.

Sitting too long with the spine 15 in improper seated posture leads to chronic pain and potential back injury (i.e., repetitive stress injury). Unfortunately, sitting for long periods of time is unavoidable for many people, for example, people working in offices, farmers, people operating heavy machinery or public transportation, etc. Thus, it is important that the chair back(s), in combination with the seat in which the user is expected to sit for extended periods of time, provides proper support and reduces peak pressures within all of the support surfaces to allow the user to rest and/or focus on a task. Such a combination of a seat and chair back(s) also encourages proper posture for the entire spine 15 while again not sending nociceptive pain signals to the brain.

Figure 8:
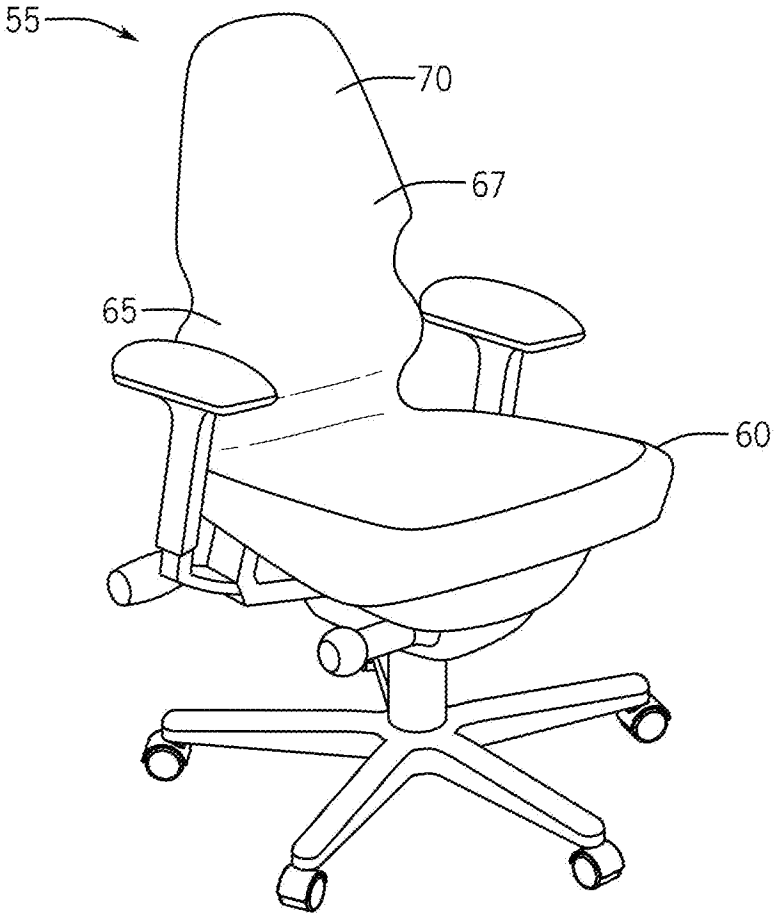
FIG. 8 depicts the seat with a cover positioned over the seat, upper back support and lower back support.

FIGS. 3-6 depict an example seat configuration 55 including a seat 60, a first or lower back support 65 (e.g., a pelvic-sacral-lumbar back support) and a second or upper back support 70 (e.g., a thoracic-cervical back support), described in more detail herein. The example seat configuration 55 is an ergonomic design that encourages a comfortable and adaptable ergonomic posture for each unique user. The example seat 60 and back supports 65, 70 promote proper seated posture for the user. Not only do the back supports 65, 70 promote proper posture, but the seating configuration 55 also provides prolonged comfort and support to the user to help the user comfortably remain in the proper seating position for an extended period of time. When the back supports 65, 70 are in the proper positions for a specific user, the seat and back supports 65, 70 ideally hold the user's pelvis within three degrees of a neutral position, thus supporting each unique user's body shape in proper alignment from the lumbar to the cervical regions with very limited engagement of user's core and upper back muscles. While the example first and second back supports 65, 70 are shown as separate back supports, the first and second back supports 65, 70 may be connected using any flexible means of flexible membrane 67, which may include a cover over the supports 65, 70 or may just stretch between the supports 65, 70, that enables adjustment of at least one back support relative to the other back support. The flexible membrane 67 may include fabric, foam, mesh, a spring or springs, or any other flexible connection. Similarly, while the back supports 65, 70 are depicted as being separate from the cushion, the lower back support may be connected to the cushion using any of the flexible membrane 67 which allow movement of the back support relative to the cushion. Additionally or alternatively, a flexible fabric or material (including a foam) may cover one or more of the cushions, first back support, and second back support. That is, one or more of the cushions, first back support 65, or second back support 70 may be covered together and/or separately using upholstery, which may include a foam layer. Examples of the flexible membrane 67 are depicted in FIGS. 7 and 8. FIG. 7 depicts the seat with a flexible membrane 67 in the form of a cover positioned over the upper and lower back supports 65, 70. FIG. 8 depicts the seat with a flexible membrane 67 in the form of a cover positioned over the seat 60, upper back support 65 and lower back support 70.

The example seat configuration 55 includes a seat 60 that includes a contoured pelvic well 95 and inclined femoral surface 97, both of which are retaining features that prevent forward migration of the user's pelvis, allowing an input of the pelvic-sacral-lumbar support 65 to rotate the pelvis upward and hold the pelvis in the neutral state. The pelvic well 95 and the inclined femoral surface 97 provide a force in the posterior and downward direction (from the anterior side of the pelvis) to counteract the force of the first and thoracic-cervical supports in the anterior direction (from the posterior side of the pelvis). Thus, the pelvic well 95 and inclined femoral surface 97 maintain the position of the user toward the rear of the seat 60 to keep the user's pelvis in contact with the pelvic-sacral-lumbar support 65 and keep the user's thoracic region in contact with the thoracic-cervical support 70. In fact, a study has shown that a contoured seat surface has a greater effect on uniformity of pressure distribution and that a lower peak pressure implied an improvement of the user's comfort on the seat. Thus, the example seat 60 including the pelvic well 95 and inclined femoral surface 97 provides greater comfort by reducing the seating pressures in addition to maintaining the position of the user so that the user can feel the full effect of the pelvic-sacral-lumbar and thoracic-cervical supports 65, 70.

Figure 3:
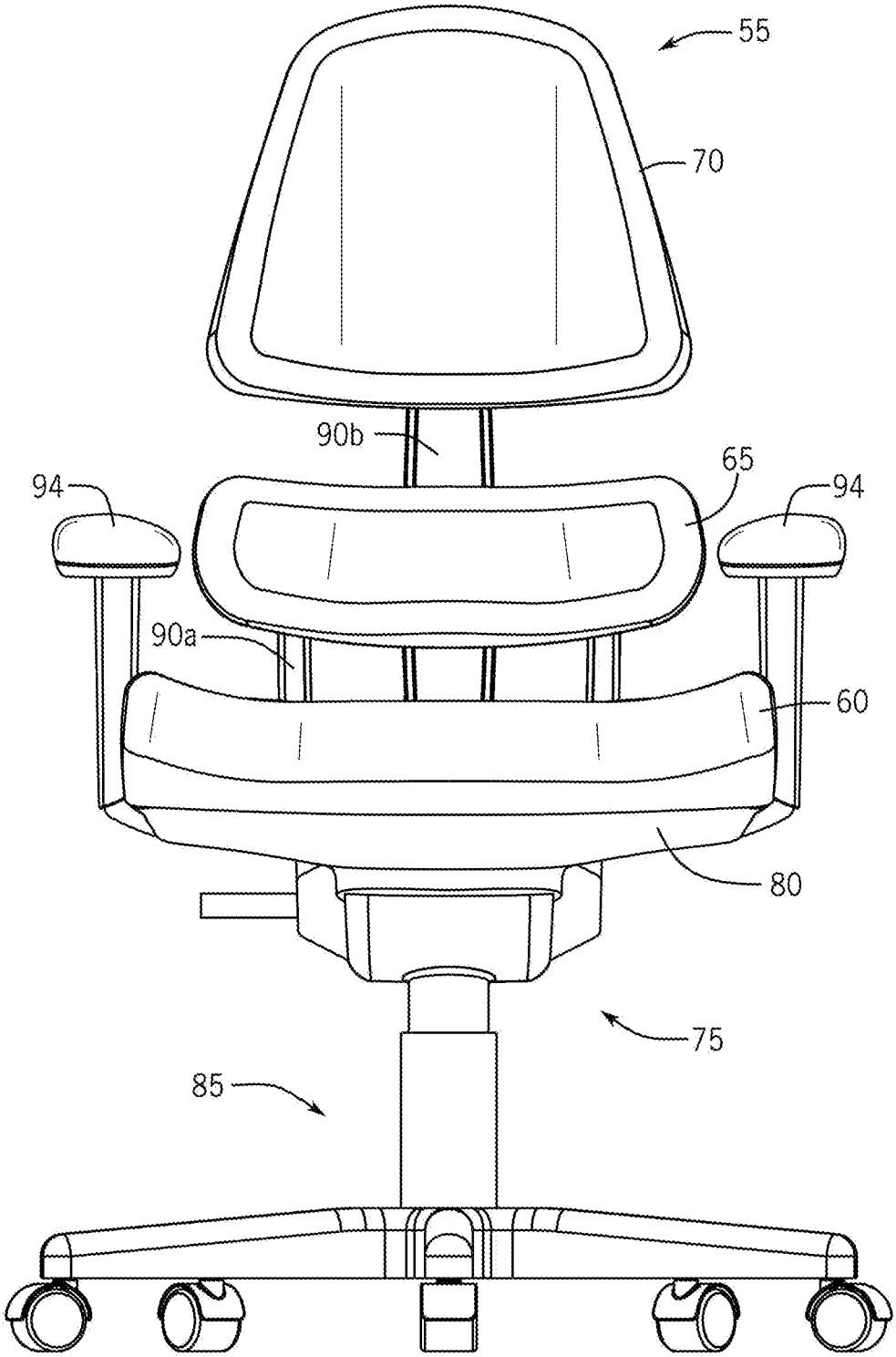
FIG. 3 depicts an example use of an example seat, a lower back support, and an upper back support described herein, which can promote a proper seating posture by lowering peak sitting pressures while aligning an upper thoracic-cervical region over a neutrally positioned pelvic-sacral-lumber region of the user.

The illustrated construction of FIG. 3 depicts the seat 60 and back supports 65, 70 in use with an example office chair 75 (e.g., a task chair, an executive chair, etc.). The seat 60 in the example construction depicted in FIG. 3 is attached to a seat pan 80 and base 85 of an example office furniture. The back supports 65, 70 are attached to the base 85 of the example office furniture using one or more frame members (e.g., first support arms 90*a*, second support arms 90*b*) coupled to respective back surfaces 92*a*, 92*b* (shown in FIG. 6) of each back support 65, 70. The example office chair may also include arm rests 94.

Alternatively, a seat 60 and back supports 65, 70 as described herein may be used in other environments. For example, the configuration 55 of the seat 60 and back supports 65, 70 may be used in a vehicle, an airplane, an entertainment venue, in industrial and/or farming equipment, or generally in any type of chair or seat in which the user is expected to sit in a plurality of positions for long periods of time, ideally with positive comfort over time. The design of the seat 60 and the pelvic-sacral-lumbar and/or thoracic-cervical supports 65, 70 can be adapted for use in a plurality of other seating situations, for example, by attaching the seat 60 to a different base and the pelvic-sacral-lumbar and/or thoracic-cervical supports 65, 70 to a different type of back frame and/or seat. The configuration 55 of the seat 60 and back supports 70 is such that the proper curvature of the spine is established and is comfortable for seated tasks, such as using a computer, operating heavy machinery, or driving, but may also be beneficial for sitting in a comfortable upright position as a passenger (e.g., of public transportation, a plane, etc.) or watching a movie, performance, or game in theater/stadium style seating. The seat 60 may also be used with solutions for mobility challenged users (e.g., wheelchairs (both manual and power), feeder seats, strollers, bathing chairs, adaptive car seats, other durable medical equipment, etc.). The pelvic-sacral-lumbar support and/or the thoracic-cervical support may also be used with such mobility devices within the durable medical equipment industry. For example, the pelvic-sacral-lumbar support 65 and/or thoracic-cervical support 70 may be pivotally coupled to a frame of a wheelchair or power chair to support a user's pelvis while in the wheelchair. The example cushion or seat 60 described herein may also be used with the wheelchair instead of a traditional cushion or flat seat.

Figure 4:
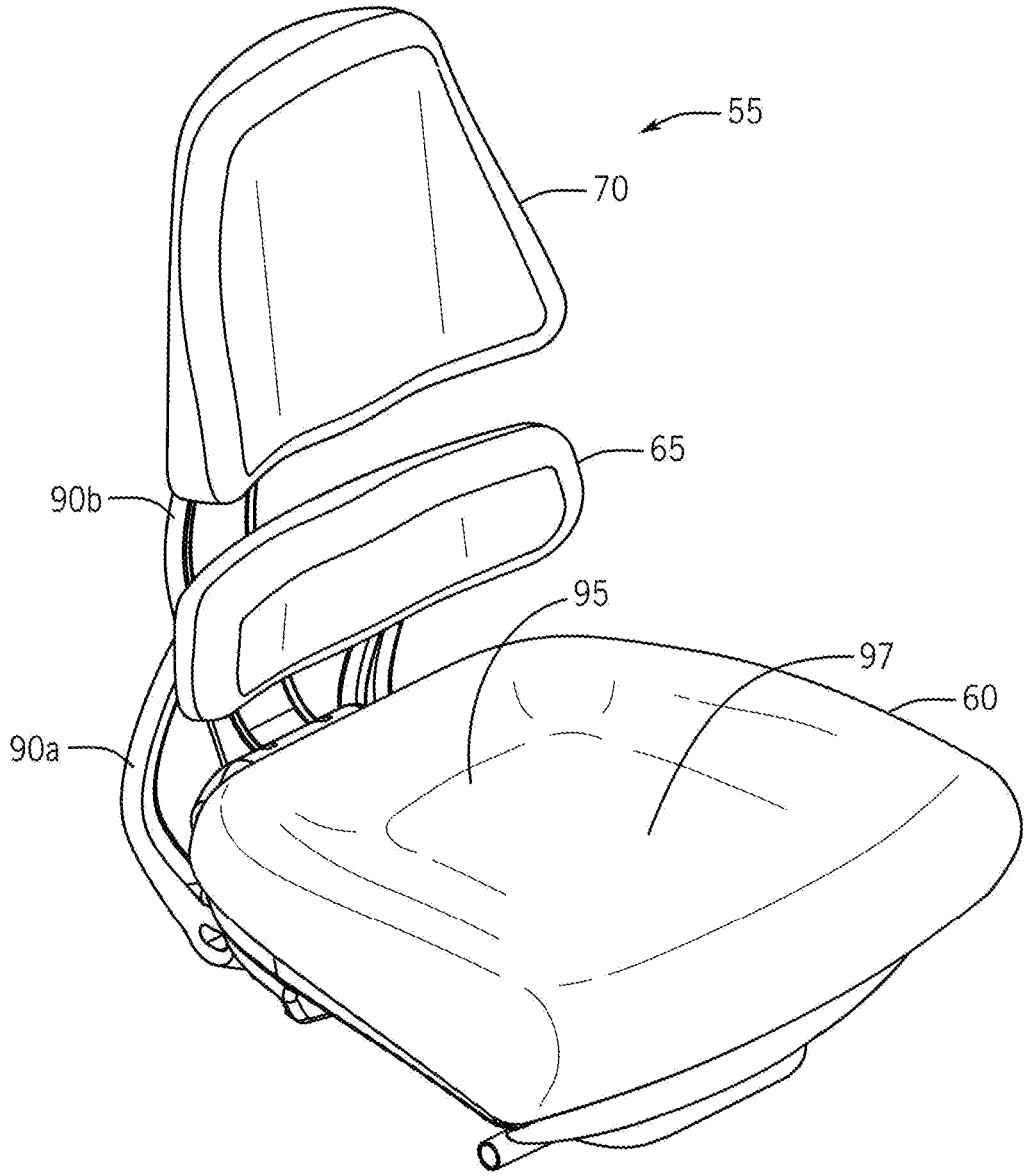
FIG. 4 is a perspective view of the seat, upper and lower back supports of FIG. 3.
Figure 5:
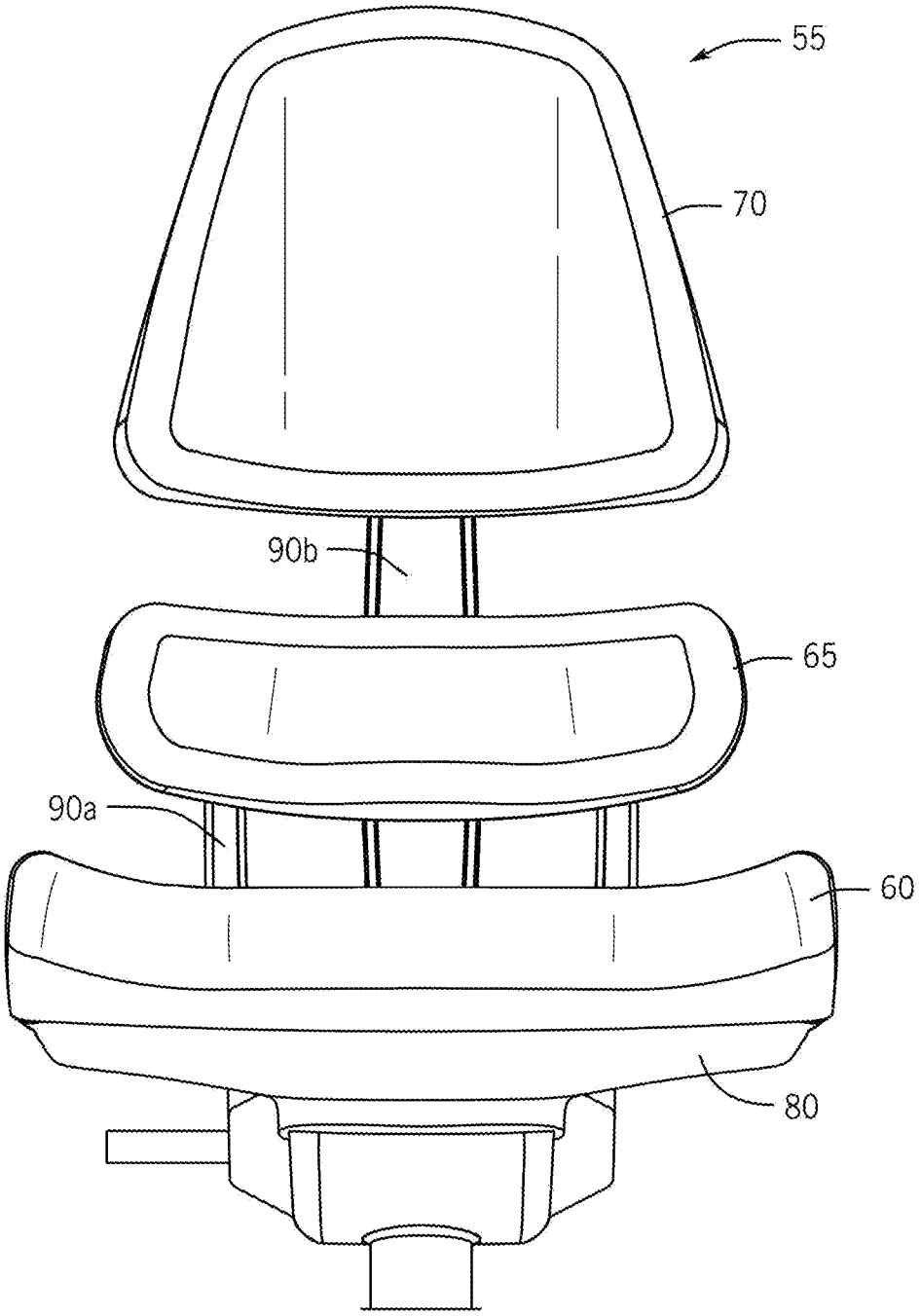
FIG. 5 is a front view of the seat, upper and lower back supports shown in FIG. 4.
Figure 6:
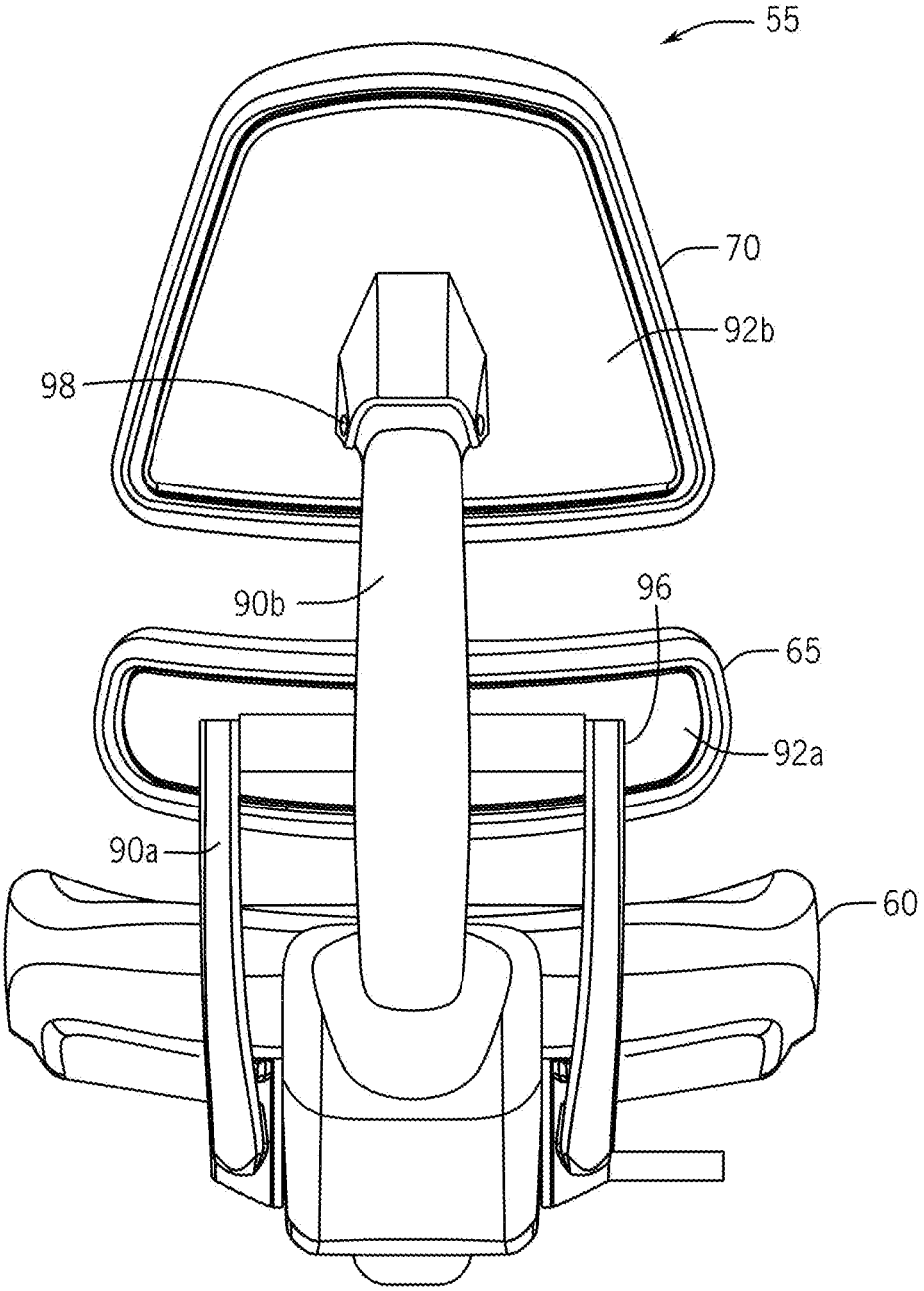
FIG. 6 is a back view of the seat, upper and lower back supports shown in FIG. 4.
Figure 7:
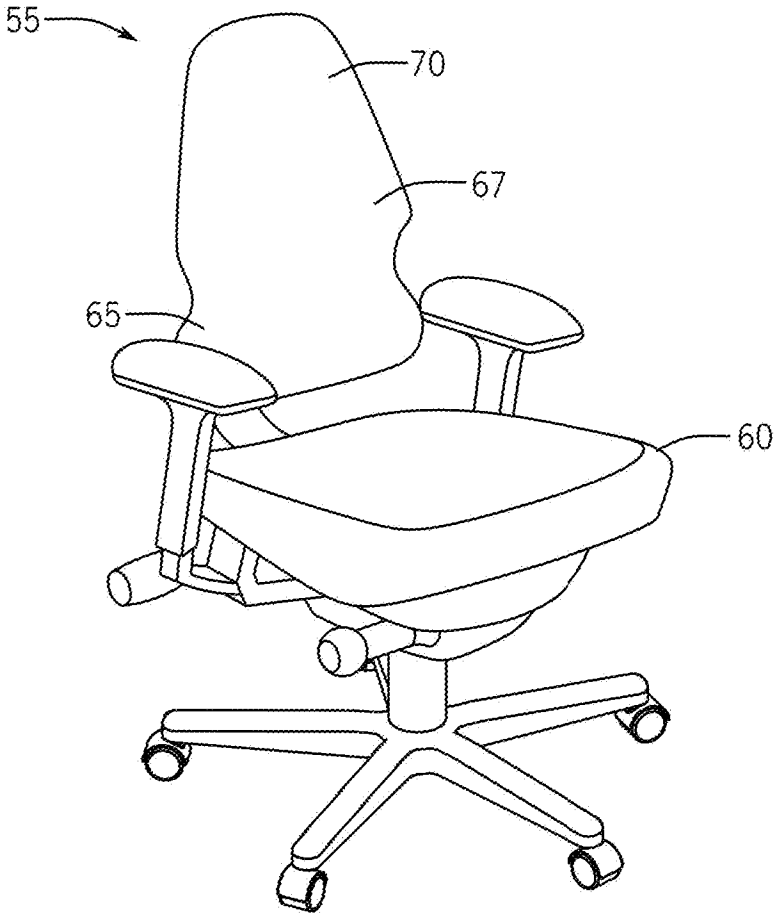
FIG. 7 depicts the seat with a cover positioned over the upper and lower back supports.

FIGS. 4-6 are various views of the example seat 60 and back supports 65, providing pelvic support and thoracic support, which may be used in the environment depicted in FIG. 3. The seating configuration 55 allows the user to comfortably sit with proper posture while engaging fewer muscles, and thus experiencing less fatigue. The seat configuration 55 includes the seat portion 60 that includes a pelvic well 95 in which the sit bones of the user are positioned and a lower back support (e.g., pelvic-sacral-lumbar support) 65 that supports and lifts the pelvic-sacral-lumbar region 10 of the user to prevent posterior collapse in the user while the user is sitting. The seat configuration 55 may also include an upper back support (e.g., thoracic-cervical support) 70, which contacts the thoracic-cervical spine 30 to help create a natural curve of the spine 15. Additionally, the upper back support 70 provides lateral support of the thoracic-cervical spine 30 by cradling at least a portion of the user's lower ribs to stabilize the user in an upright position without requiring the user to engage their lateral core area (e.g., the transverse and oblique abdominal muscles) to hold themselves centered on the back supports. The thoracic-cervical support contacts the thoracic region, specifically the T10-T12 segments of the spine, and provides support to encourage proper alignment of the thoracic-cervical region of the spine. Thus, when properly adjusted, the thoracic-cervical support is capable of reducing anterior tilt/collapse/flexion in the thoracic region and encourages the shoulders to retract, helping the user to maintain an upright alignment. As a result, this configuration 55 encourages the proper seated posture in a user that causes the least amount of pressure and shear pain while sitting; thus providing a comfortable seat for a longer period of time, and thereby reducing muscle imbalances and aiding in reducing back, shoulder, and neck injuries. The placement of the two back supports 65, 70 creates a natural curve in the lumbar region 25 of the spine 15 without requiring a support to apply pressure specifically to just the lumbar/sacral region 25. Instead of applying pressure only to the lumbar region of the spine, the upper and lower back supports 65, 70 support the pelvic-sacral-lumbar region 10 (e.g., the pelvis, the sacrum, and the L4 and L5 spinal segments of the lumbar region) and the thoracic-cervical region 30 of the spine 15.

Figure 9:
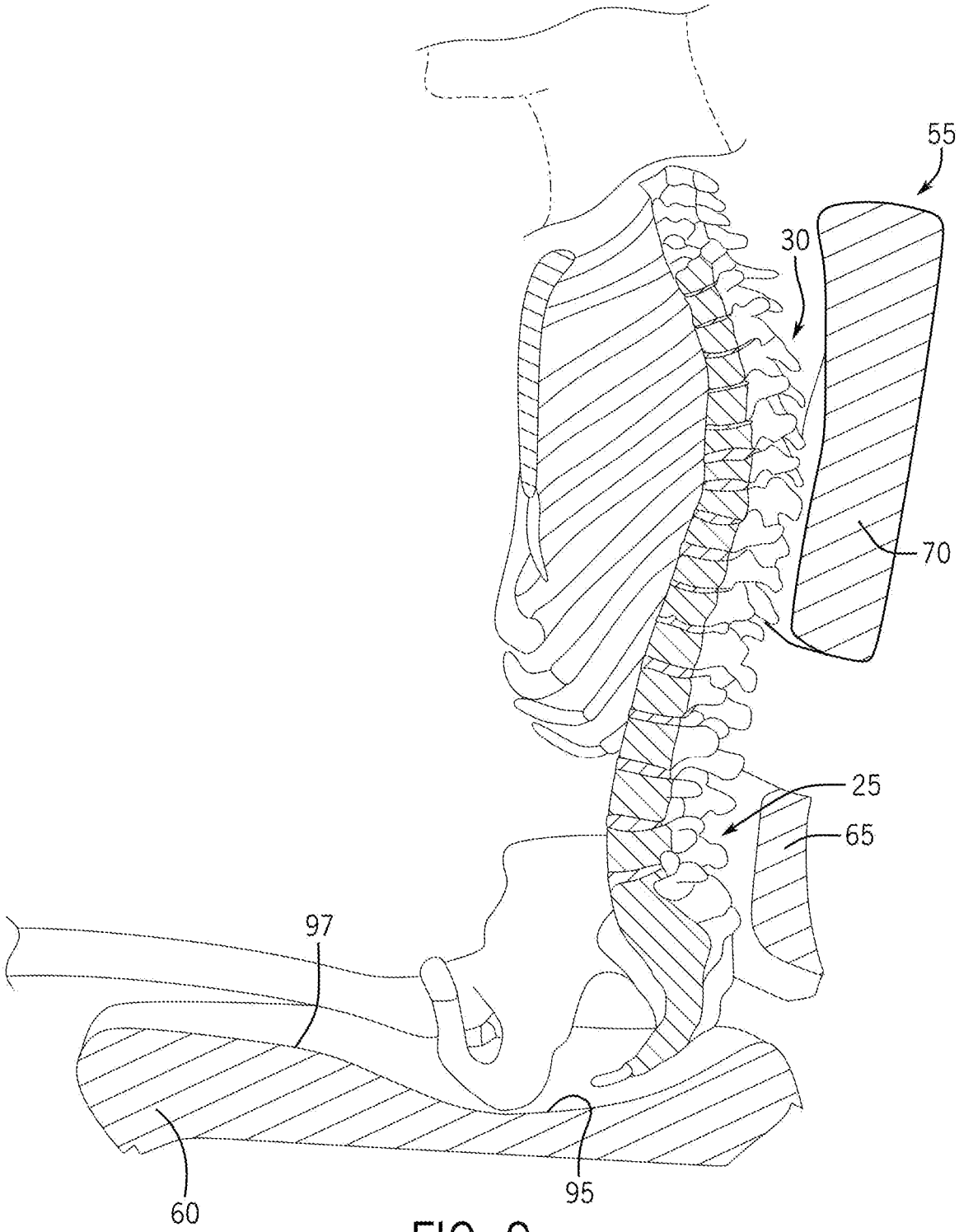
FIG. 9 is a partial skeletal cross-sectional view of a user of the example seat configuration described in conjunction with FIGS. 1-6.

FIG. 9 is a partial skeletal cross-sectional view of a user of the example seat configuration 55 described herein. As depicted in FIG. 9, the user's pelvic-sacral-lumbar region is cradled in a pelvic well 95 and the inclined femoral surface 97 of the seat 60 and supported by the pelvic-sacral-lumbar support 65 to achieve the proper posture as described above. The user's thoracic-cervical region is supported by the thoracic-cervical support 70 to prevent anterior lean, as described above. Additionally, FIG. 9 depicts how the example seat configuration described herein allows for proper spinal alignment and disc spacing throughout the length of the user's spine.

Figure 10:
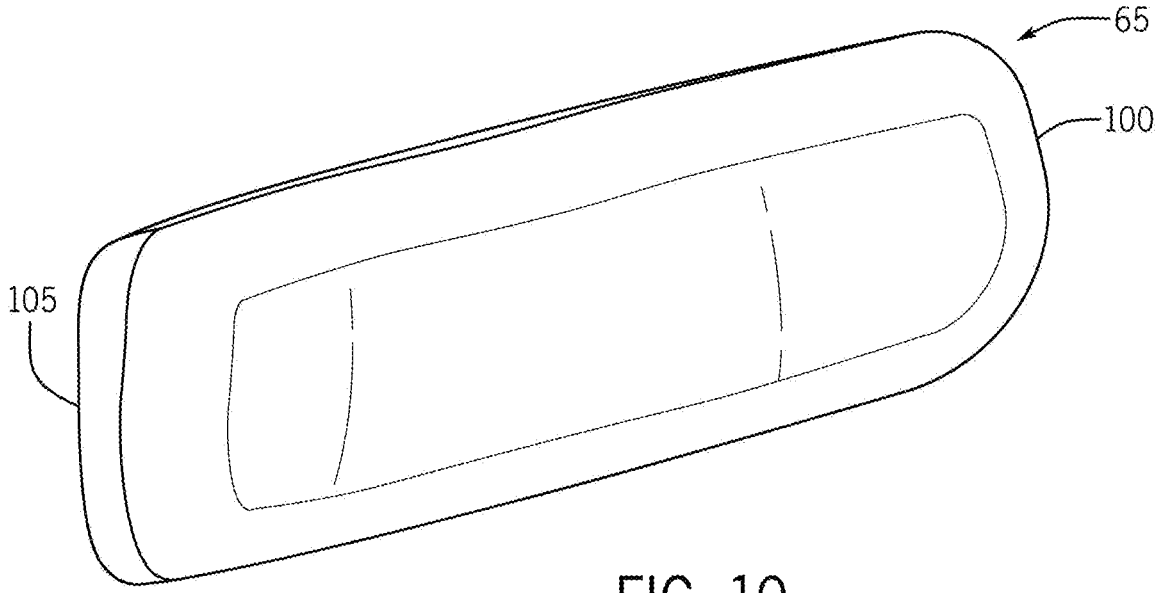
FIG. 10 is a more detailed perspective view of the lower back support shown in FIGS. 4-6.
Figure 11:
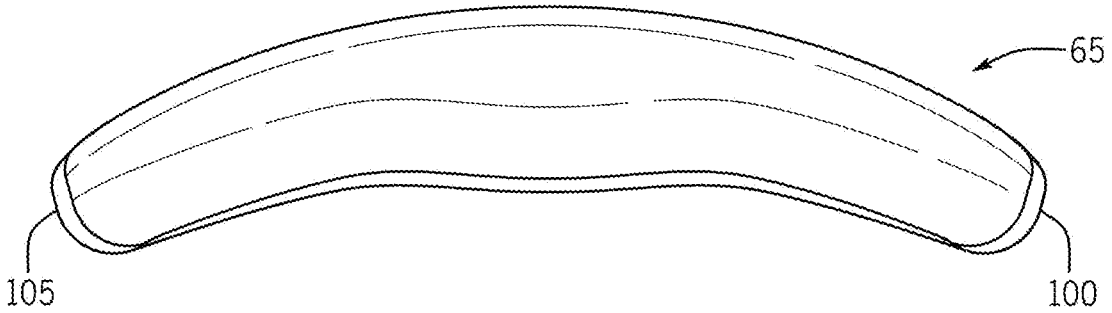
FIG. 11 is a top view of the lower back support shown in FIG. 10.
Figure 12:
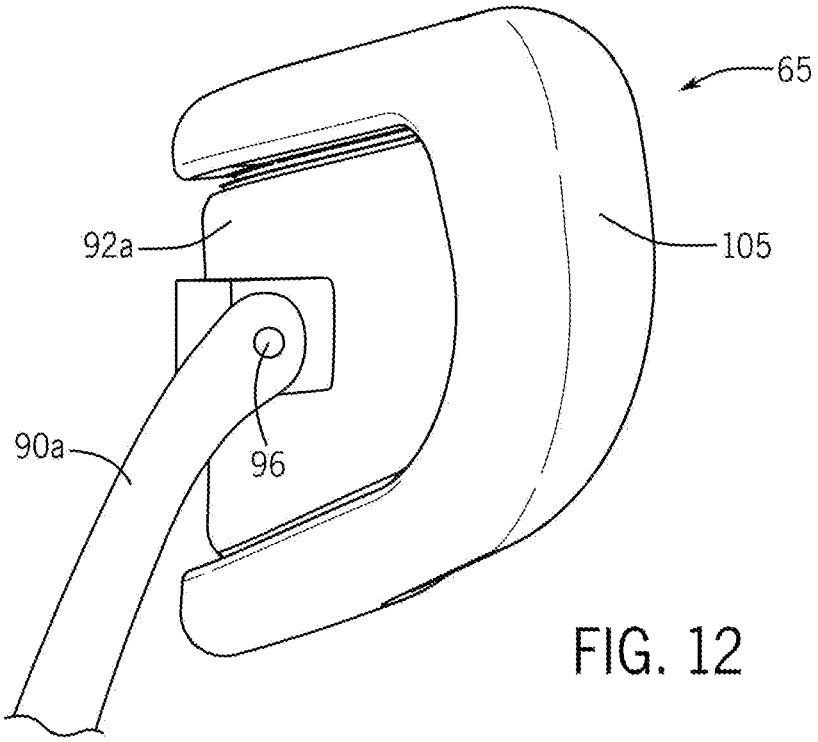
FIG. 12 is a side view of the lower back support shown in FIG. 10.

FIGS. 10-12 are more detailed views of a first example back support (e.g., lower back support, a pelvic-sacral-lumbar support) 65. The example pelvic-sacral-lumbar support 65 is shaped and oriented to support and lift the pelvic-sacral-lumbar region 10. The pelvic-sacral-lumbar support 65 in combination with the first support arms 90*a* helps align and hold the pelvic-sacral-lumbar region 10 in a neutral position so that the lower spine 25 (e.g., the lumbar portion of the spine) is urged into a natural curve with the assistance of the iliolumbar ligaments. Thus, the pelvic-sacral-lumbar support 65 not only aligns and supports the pelvic-sacral-lumbar region 10, but also aids in the proper alignment of the user's spine 15.

The example pelvic-sacral-lumbar support 65 has a curved profile, as shown in the perspective view of FIG. 10 and in the top view of FIG. 11. Not only does the pelvic-sacral-lumbar support 65 curve inward toward the edges 100, 105, but also gradually angles upward as well. Both the inward curve and/or the slight upward angle toward the edges help lift and support the pelvis of the user by making more contact with the user's pelvic-sacral-lumbar region 10 adjacent to the pelvic bones as compared to a flat pad. All support surfaces in this design are intended to try to reduce peak pressures as much as possible for the majority of users. In other examples, the pelvic-sacral-lumbar support 65 may have a different shape or surface contour and/or no surface contour, while still maintaining contact with the user's pelvis. The example pelvic-sacral-lumbar support 65 has a substantially continuous curve, but may alternatively have three distinct portions, or may be an even smoother curve or flat. In such examples where the pelvic-sacral-lumbar support 65 is flat, a memory foam may be used to allow for additional contact with the user's pelvic-sacral-lumbar region. In some example constructions, a back or outer surface 92*a* of the pelvic-sacral-lumbar support 65 may have similarly shaped curve, or may not follow the curve of the inner surface of the pelvic-sacral-lumbar support 65.

In addition to the upward angles toward the edges of the pelvic-sacral-lumbar support 65, in some examples the entire pelvic-sacral-lumbar support 65 may be pretensioned with an upward angle bias (e.g., using a spring or other biasing mechanism) that is reduced in angle as the user sits so that the central part of the pelvic-sacral-lumbar support 65 appropriately fits the user and also lifts the pelvis and/or pelvic-sacral-lumbar region. That is, the pelvic-sacral-lumbar support 65 may be pivotable about a horizontal axis so that the pelvic-sacral-lumbar support 65 can pivot to adjust to fit multiple shapes and sizes of users, and an initial position of the pelvic-sacral-lumbar support 65 is biased with an upward angle. The pelvic-sacral-lumbar support 65 may also be adjusted and locked to different angles to fit different sizes of users.

However, in some examples, the pelvic-sacral-lumbar support 65 is pivotably fixed (e.g., does not pivot about the connection to the support arm). A pivotably fixed pelvic-sacral-lumbar support 65 may be easier to manufacture and/or may be more durable because a repetitive stress point is removed from the chair. Additionally, the angle of the pelvic-sacral-lumbar support 65 that is comfortable for the majority of users does not significantly change throughout the range of forward and backward motion (e.g., seat depth adjustment, a pelvic angle adjustment) of the pelvic-sacral-lumbar support 65. The upward bias of the pelvic-sacral-lumbar support may be more critical in a chair with a larger range of motion of the pelvic-sacral-lumbar support.

The pelvic-sacral-lumbar support 65 may be positioned just above the seat to facilitate the contact with the pelvic-sacral-lumbar region 10. The curved shape in the transverse plane of the pelvic-sacral-lumbar support 65 not only lifts and supports the pelvic-sacral-lumbar region 10, but also provides lateral stability to prevent the user from leaning to one side or the other, thereby maintaining the user in an upright position. The shape and positioning of the pelvic-sacral-lumbar support 65 ensures that the pelvic-sacral-lumbar region 10 is maintained in a natural and neutral seated position.

In some example constructions, the pelvic-sacral-lumbar support 65 is rotationally fixed (e.g., fixed about a horizontal axis, not pivotable). In example constructions in which the pelvic-sacral-lumbar support 65 is fixed, the upward and inward angles of the edges of the pelvic-sacral-lumbar support 65 are set such to accommodate as broad a range of body types and sizes as possible. A fixed pelvic-sacral-lumbar support 65 may be advantageous in some implementations of the example pelvic-sacral-lumbar support 65, such as for use in environments where the adjustability/customization of the location of the pelvic-sacral-lumbar support 65 may not be feasible (e.g., theater seating, seating on public transit or planes, etc.). Additionally, the fixed pelvic-sacral-lumbar support 65 may be used in seating systems where only one back support is desired or feasible.

In alternative example constructions, the pelvic-sacral-lumbar support 65 is pivotable around a horizontal axis (e.g., an x-axis) at a pivot point 96 (see FIG. 6). A pivotable pelvic-sacral-lumbar support 65 more closely matches a posterior shape of a range of unique individuals. Additionally, a pivotable pelvic-sacral-lumbar support 65 may facilitate movement of the user within the seating configuration 55. For example, if the user leans forward to reach an object or backwards to relax, the pelvic-sacral-lumbar support 65 can pivot accordingly and stay in supportive contact with the pelvic-sacral-lumbar region 10 of the user. In example constructions in which the pelvic-sacral-lumbar support 65 is pivotable, the pelvic-sacral-lumbar support 65 may be biased such that the entire pelvic-sacral-lumbar support 65 is angled slightly upward when no user is sitting in the seat 60. This bias helps the user sit into the seat 60 without interference from the user's garments during ingress and egress from the chair, while also enabling the pelvic-sacral-lumbar support 65 comes into matched contact with the pelvic-sacral-lumbar region 10.

In some example constructions, the height of the pelvic-sacral-lumbar support 65 relative to the seat 60 is adjustable. The height of the pelvic-sacral-lumbar support 65 may be adjustable by the user to better fit the user's body such that the pelvic-sacral-lumbar support 65 is substantially in the ideal position to properly support and lift the user's pelvic-sacral-lumbar region 10. For example, a taller user (e.g., a user above an average height for an adult) may need the pelvic-sacral-lumbar support 600*a* different relative height than a shorter user (e.g., a user below an average height for an adult). Thus, an adjustable height construction of the pelvic-sacral-lumbar support 65 enables the pelvic-sacral-lumbar support 65 to accommodate a broader range of users to effectively lift and support the user's pelvic-sacral-lumbar region 10. Additionally or alternatively, the pelvic-sacral-lumbar support 65 may move from the back of the seat toward the front of the seat to adjust effective seat depth and to accommodate different heights and sizes of users.

Figure 13:
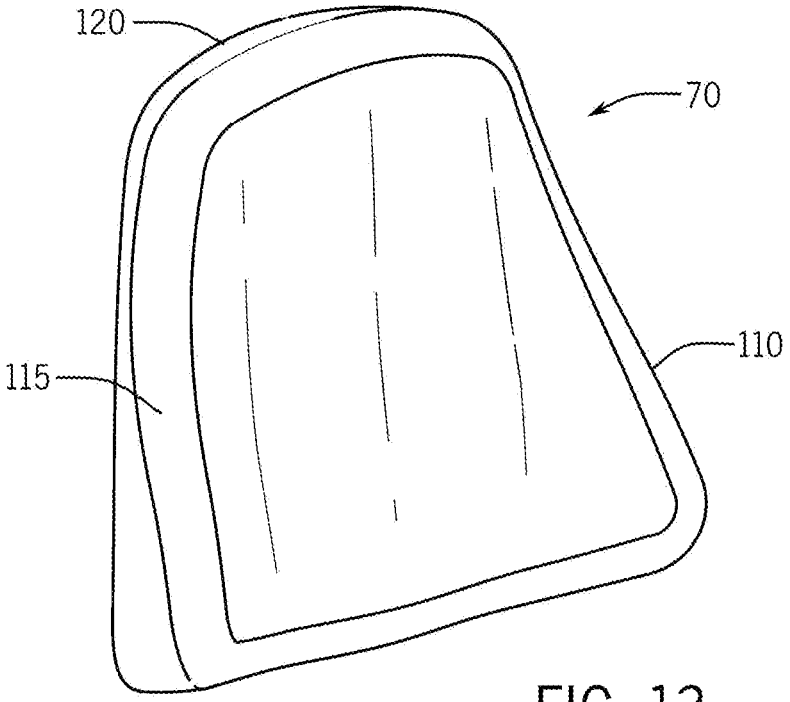
FIG. 13 is a more detailed perspective view of the upper back support shown in FIGS. 4-6.
Figure 14:
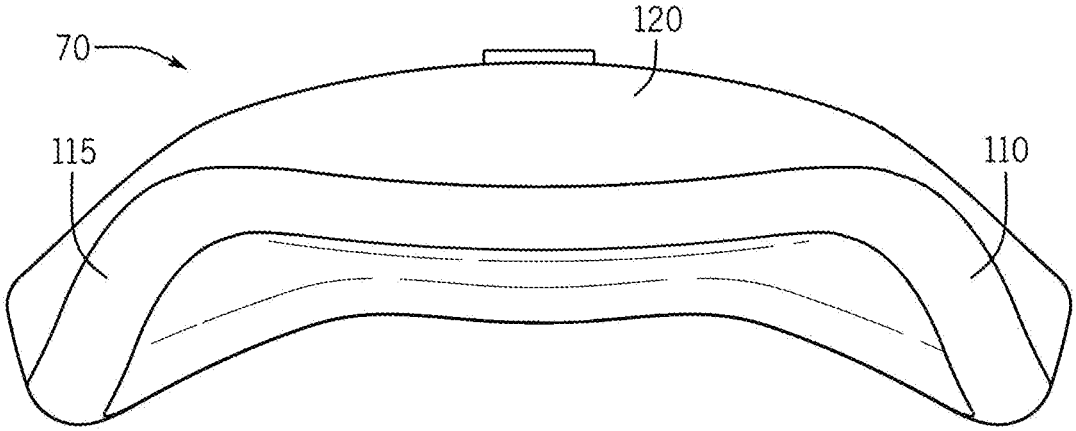
FIG. 14 is a top view of the upper back support shown in FIG. 13.
Figure 15:
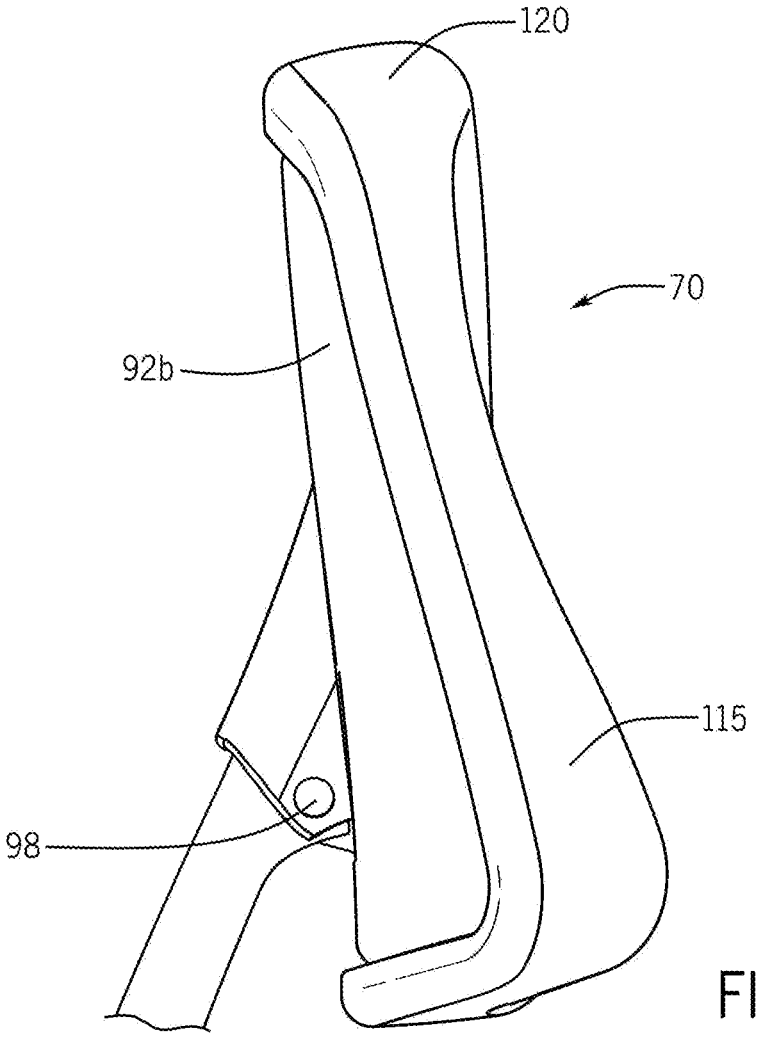
FIG. 15 is a side view of the upper back support shown in FIG. 13.

The example seating configuration 55 also includes a second example back support (e.g., a thoracic-cervical support) 70, as show in FIGS. 13-15. The thoracic-cervical support 70 helps support the thoracic-cervical region 30 of the user's spine 15. The majority of people who sit for extended periods of time ultimately end up in a slumped forward position, particularly in the thoracic-cervical region 30 of the spine due to muscle fatigue and/or muscle strain of keeping the thoracic-cervical region in an upright position. The thoracic-cervical support 70 is shaped to promote the proper curve in the thoracic-cervical region 30 of the spine 15. The thoracic-cervical support 70 also supports the scapulas (e.g., shoulder blades) to maintain a proper posture of the shoulders when in a seated position. Similar to the rolling forward of the thoracic-cervical region 30 when sitting, many people roll their shoulders forward rather than keeping them retracted backwards when in a seated position.

In a typical seated position, rolling the shoulders forward is easier than keeping the shoulders back because keeping the shoulders back for an extended period of time creates strain and fatigue in the upper back and shoulder muscles, particularly the rhomboid muscles and the trapezius muscle. The thoracic-cervical support 70 contacts the thoracic-cervical region, specifically the T10-T12 segments of the spine, and provides support to encourage proper alignment of the thoracic-cervical region of the spine. Thus, when properly adjusted, the thoracic-cervical support 70 is capable of preventing anterior lean/tilt/flexion of the thoracic region and encourages the shoulders to retract, helping the user to maintain an upright alignment. This allows the user to be able to sit in a position with proper posture for an extended period of time without muscle fatigue, discomfort, soreness, or muscle pain. The example thoracic-cervical support 70 makes it easier for the user to maintain proper posture, thus promoting and enabling good spinal health for extended periods of time. The vestibular system, which controls the position of the body at rest and provides the brain with information relating to motion, head position, and spatial orientation works in tandem with the thoracic-cervical support 70 to help neutrally align the thoracic region and comfortably position the head. Due to every person's unique sense of their center of balance, each user has the ability to optimize the location of the thoracic-cervical support 70 to find the proper balance point of their head. A person's sense of balance relies on a series of signals to the brain from several organs and structures in their body. The part of the ear that assists in balance is known as the vestibular system. When a person moves, the vestibular system detects mechanical forces, including gravity, that stimulate the semicircular canals and the otolithic organs (Vestibular System). These organs work with other sensory systems in your body, such as the vision and the musculoskeletal sensory system, to control the position of a person's body at rest or in motion. Without the adjustable thoracic-cervical support, a balance point cannot be achieved for each individual.

The illustrated thoracic-cervical support 70 has a substantially trapezoidal shape (e.g., a modified trapezoidal shape with rounded corners and curved edges). The back of the user rests on the center portion. The left and right side portions 110, 115 are angled inward to contact at least a portion of the user's ribs (e.g., a portion of at least the two lower ribs) to promote lateral stability (i.e., to prevent the user from leaning to one side or the other, thereby maintaining the user in an upright position). Even a slight contact of the ribs is sufficient to laterally support the user.

The left and right angled edges may be substantially straight, but still allow for more movement of the user's arms and shoulders than a typical chair due to the substantially trapezoidal shape of the thoracic-cervical support 70. Alternatively, the left and right angled edges may have a curved or cutout portion to allow the user to more easily move their arms into a retracted or reaching position (e.g., to reach for something to one side, to stretch, etc.). In either construction, the thoracic-cervical support 70 provides support to the scapulas to keep the scapulas pushed in. Specifically, the trapezoidal shape falls within the thoracic cavity of the user. Anything wider than the thoracic cavity will interfere with the arms or elbows of the user, not allowing for full retraction or reach of the arms of the user.

A top edge 120 of the example thoracic-cervical support 70 is thicker than the bottom portion of the thoracic-cervical support 70 and is angled inward. The example top edge 120 helps promote the correct curvature of the thoracic-cervical spinal region 30. However, in alternative examples, the top edge 120 may be the same thickness as the rest of the thoracic-cervical support 70 and may not be angled forward. In such examples, the thoracic-cervical support 70 is still effective to support the user's thoracic-cervical region 30 in a proper seated posture with minimal muscle engagement. Even without the inwardly curved upper edge, the user is able to easily maintain shoulder retraction and the proper curve of their thoracic-cervical spinal region 30 due to the pelvic well 95 in the seat 60 and the pelvic-sacral-lumbar support 65 providing the foundation for proper posture for the entire spine 15.

The example thoracic-cervical support 70 can be moved in an inward (anterior) and outward (posterior) direction relative to the seat 60. Additionally, the thoracic-cervical support 70 may have an adjustable height. Preferably, the height adjustment is done through the center support of the chair (e.g., using a telescoping center support that is attached to a back support). However, the height adjustment can be made at the back support 70 (e.g., using multiple different holes through which a pin can be placed, or other similar adjustable feature, to adjust the height of each back supports 65, 70). The adjustment allows the thoracic-cervical support 70 to be positioned in the correct spot to promote proper anatomical alignment of the user without significant engagement of the user's core and back muscles. More specifically, the forward and backward adjustment ensures that the thoracic-cervical support 70 maintains proper posture by keeping the user balanced over the pelvic-sacral-lumbar region 10. The height adjustment ensures that the inwardly angled sides are in contact with at least a portion of the lower ribs and not so high as to make moving the shoulders difficult.

The thoracic-cervical support 70 may also pivot about a horizontal axis at a pivot point 98 (see FIG. 6), similar to the pelvic-sacral-lumbar support 65. This allows the support surface to closely match the shape and angle of user's thoracic region. The thoracic-cervical support 70 being pivotable also allows the thoracic-cervical support 70 to accommodate a wider range of body types and sizes. Pivotability additionally helps the thoracic-cervical support 70 maintain contact with the user when the user makes slight movements or adjustments while sitting in the chair. The pivotability of the thoracic-cervical support 70 also helps maintain contact while trying to achieve balance point and seat comfort, including proper extension (decompression) of the spine.

To further aid in proper pelvic-sacral-lumbar support and alignment, the example seating configuration 55 includes a seat 60 with the pelvic well 95 and inclined femoral surface 97 formed in the structure of the seat 60, as shown in FIGS. 16-19. The pelvic well 95 integrated into the seat 60 and/or seat cushion creates a space in the seat 60 in which the pelvic-sacral-lumbar region 10, specifically the ischial tuberosity (or sit bones), rests. The pelvic well 95 is created in the seat 60 such that the pelvic well 95 is a more natural fit to the human shape, thus reducing peak pressures of the user's IT's by generally redistributing pressures throughout the sitting surface area. The pelvic well 95 and inclined femoral surface 97 also position the user's pelvic-sacral-lumbar 10 in an appropriate position such that the pelvic-sacral-lumbar support 65 is able to make contact with the pelvic-sacral-lumbar region and give the user proper support.

Figure 16:
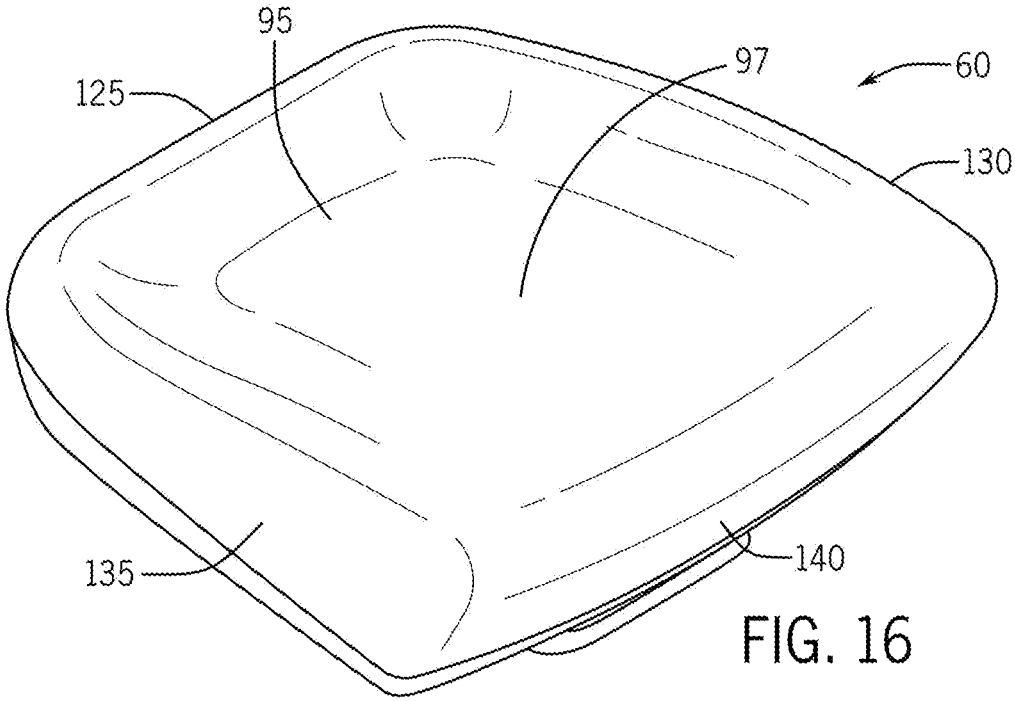
FIG. 16 is a more detailed perspective view of the seat in FIGS. 4-6.
Figure 17:
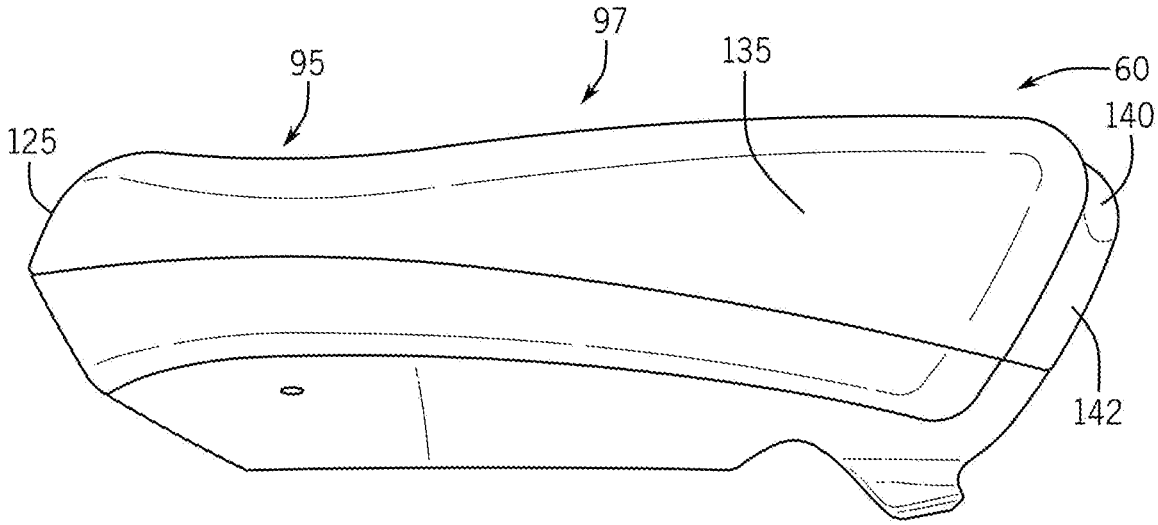
FIG. 17 is a side view of the seat shown in FIG. 16.
Figure 18:
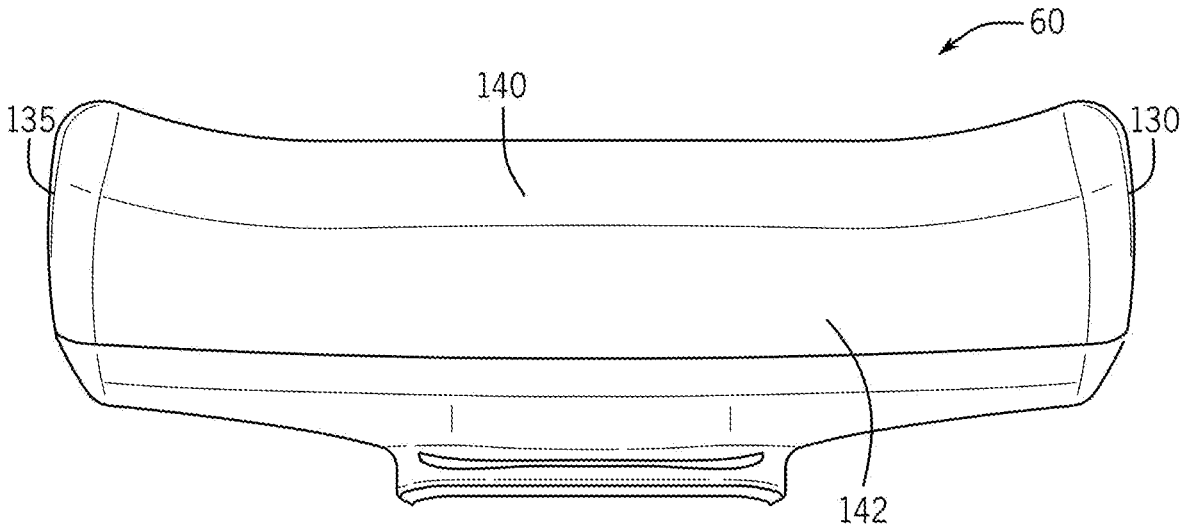
FIG. 18 is a rear view of the seat shown in FIG. 16.
Figure 19:
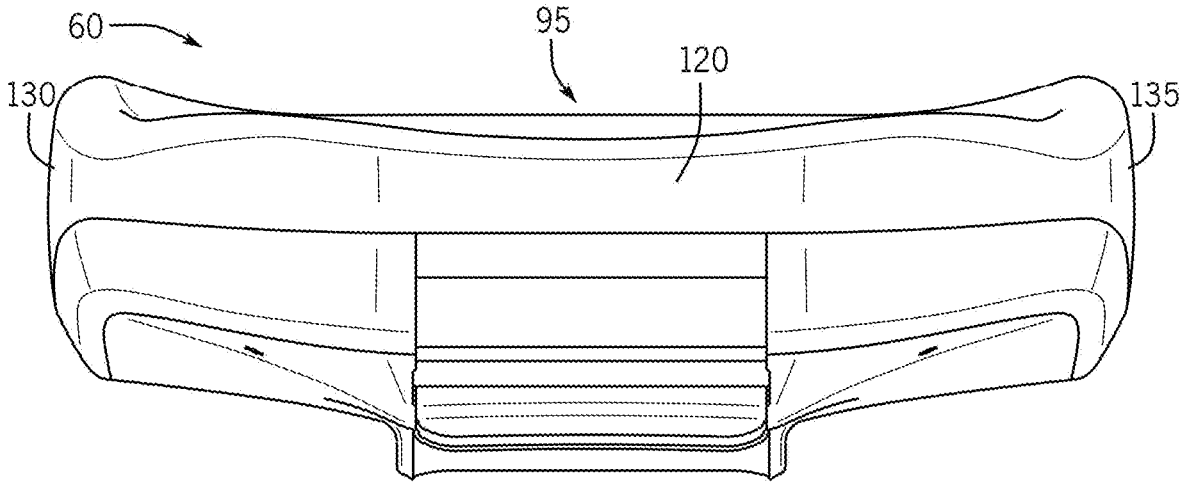
FIG. 19 is a front view of the seat shown in FIG. 16.

In the example construction depicted in FIG. 16, the pelvic well 95 and inclined femoral surface 97 are molded into the material of the seat 60. In an example of the seat 60 being implemented in a cushioned chair or seat (e.g., an office chair, a tractor seat, etc.) the cushion may be made of a foam or other material, such as gel, and the pelvic well 95 and inclined femoral surface 97 are molded into the desired shape of the seat cushion such that the peak pressures on the ITs are below 100 mmHg. A foam seat cushion may be an injection molded foam cushion so that the pelvic well 95 is built-into the construction of the cushion. The foam seat cushion may also be cut from a uniform block of foam in which the pelvic well 95 is further cut. An example construction of the seat 60 without a cushion (e.g., a plastic seat) may also include a pelvic well 95 molded (e.g., injection molded) into the material of the seat 60.

The pelvic well 95 is positioned adjacent a back edge 125 of the seat 60 where a user's pelvis would be positioned when the user is sitting in an upright position with proper posture. The example pelvic well 95 may have a shape corresponding to a shape of the pelvis and gluteus muscles when in a seated position. For example, sides 130, 135 (e.g., left and right sides of the pelvic well adjacent left and right sides of the seat) of the pelvic well 95 may be curved in a similar manner as a curve of a user's hips and/or gluteus muscles when in a seated position. This side edge/curve extends to a front edge 140 of the seat 60, forming an elevated edge along the entire length of each the left and the right sides of the seat 60. The front edge of the seat is at a height above the pelvic well to create increased pressure on the distal end of the femurs, thus increasing pressure distribution area as well as decreasing pressure on the IT's. A back edge of the pelvic well 95 adjacent to the back edge of the seat may be curved to correspond to a curve of the user's pelvic-sacral-lumbar region 10 and gluteus muscles, which further increases the pressure distribution area and helps assist the lifting of the pelvis in conjunction with the input from the pelvic-sacral-lumbar support 65.

The slope toward the pelvic well 95 encourages the proper placement of the pelvis in the pelvic well 95. Additionally, the pelvic well 95 and inclined femoral surface 97 may help relieve pressure or shear underneath and surrounding the region of the IT's. The shape of the pelvic well 95 helps cradle and support the user's lower pelvic region or sitting surface and maintain the position of the user's pelvis on the seat 60 such that the pelvic support 65 can maintain contact with the pelvic-sacral-lumbar region 10. Additionally, the pelvic well 95 and inclined femoral surface 97 hold the user in place on the seat 60, reducing or preventing sliding of the user while the user is sitting in the seat 60. Additionally, the left and right edges are raised to help the user position themselves in the center of the seat so that the pelvic-sacral-lumbar and thoracic-cervical supports 65, 70 can work properly to support the user.

In addition to the pelvic well 95, the front edge of the seat 60 may include a reverse tapered edge 142 (e.g., an edge that has a bottom surface that is undercut at an angle). The front edge may be tapered backward to act as a relief cut that more closely follow the popliteal fossa downward along the calf muscle. The relief cut helps mitigate contacting these areas, thus reducing the chance of restricting blood flow to one's lower extremities. The design of the front edge of the support surface allows the front edge of the seat to collapse under the weight of the user's legs without the edge of the seat pan contacting and causing pressure on the user's lower extremities. The front edge of the seat pan may also be as low as possible to allow plenty of space for the foam to crush under the weight of the user's legs without coming in contact of the hard front edge, which would cause a sharp pressure to the user's skin that could lead to a pressure injury. Alternatively, the front edge of the seat may be rounded, squared off, or a waterfall edge.

Figure 20:
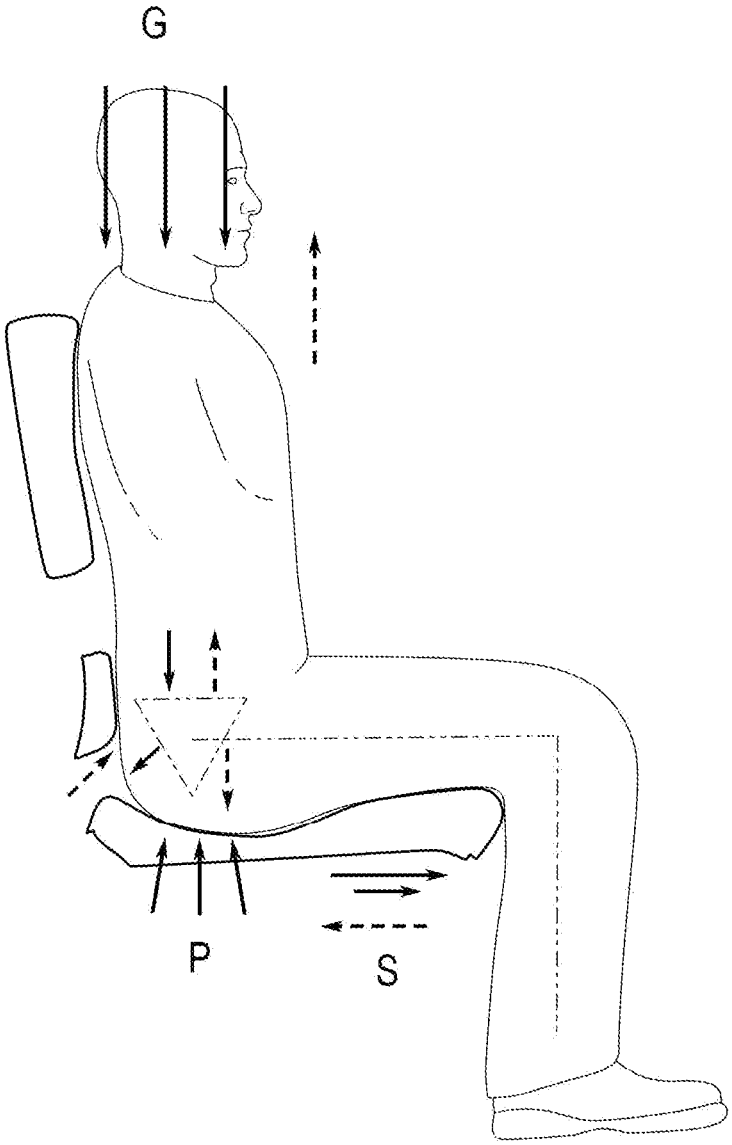
FIG. 20 depicts a representation of the forces acting on a user while sitting and the counteracting forces provided by the seat configuration described herein.

FIG. 20 depicts a representation of the forces acting on a user while sitting, including the counteracting forces provided by the seat configuration described herein. Similar to the force diagram shown in FIG. 2, the forces include gravity (G), pressure (e.g., the peak pressures on the IT's) (P), and shear stress (S). In the example construction, the forces acting on the user while sitting are represented using solid arrows. Counteracting forces, or balancing forces are represented using dashed arrows. The example seat configuration 55 described herein counteracts the pressure and shear forces in all seating surfaces, the shear strain in all seating surfaces, and provides the user the opportunity to achieve postural alignment with little discomfort over time. Thus, the example seat configuration results in a reduced triggering of the nociceptors to achieve comfortable sitting for the user over long periods of time.

One or more of the disclosed embodiments, alone or in combination, may provide one or more technical effects including promoting proper ergonomic posture in a way that is comfortable for extended periods of time for a user sitting in a seat configuration described herein. The technical effects and technical problems in the specification are exemplary and are not limiting. It should be noted that the embodiments described in the specification may have other technical effects and can solve other technical problems.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that references to relative positions (e.g., "top" and "bottom," "left" and "right") in this description are merely used to identify various elements as are oriented in the Figures. It should be recognized that the orientation of particular components may vary greatly depending on the application in which they are used.

For the purpose of this disclosure, the term "coupled" means the joining of two members directly or indirectly to one another. Such joining may be stationary in nature or moveable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

It is also important to note that the construction and arrangement of the system, methods, and devices as shown in the various examples of embodiments is illustrative only, and not limiting. Although only a few embodiments have been described in detail in this disclosure, those skilled in the art who review this disclosure will readily appreciate that many various alternatives, modifications, variations, improvements and/or substantial equivalents, whether known or that are or may be presently foreseen, are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements show as multiple parts may be integrally formed, the operation of the interfaces may be reversed or otherwise varied, the length or width of the structures and/or members or connector or other elements of the system may be varied, the nature or number of adjustment positions provided between the elements may be varied (e.g. by variations in the number of engagement slots or size of the engagement slots or type of engagement). The order or sequence of any process or method steps may be varied or re-sequenced according to alternative embodiments. Other substitutions, modifications, changes, and omissions may be made in the design, operating conditions, and arrangement of the various examples of embodiments without departing from the spirit or scope of the present inventions. Therefore, the invention is intended to embrace all known or earlier developed alternatives, modifications, variations, improvements and/or substantial equivalents.

The invention claimed is:

1. A seating configuration comprising:

a first support surface having a feature to urge a user into an optimal position on the first support surface;

a second support surface positioned adjacent an expected location of a pelvic-sacral-lumbar region of the user, the second support surface comprising:

a central portion having respective side edges, the central portion being thicker than the respective side edges; and a curved profile having an inward curve toward respective side edges and a gradual angle upward curve configured to support the user's pelvis, sacrum, and L4 and L5 spinal segments; and a third support surface positioned adjacent an expected location of a thoracic-cervical region of the user, the third support surface being configured to support the user's T10-T12 spinal segments, wherein, in an operational setting, the first support surface provides counteracting support to the respective second and third support surfaces such that the first, second, and third support surfaces, respectively, together can be configured to establish a natural alignment of a spinal column of the user.

2. The seating configuration of claim 1, wherein the first support surface is a seat support surface.

3. The seating configuration of claim 1, wherein the feature to urge a user is positioned adjacent an expected location of Ischial Tuberosities of the user.

4. The seating configuration of claim 1, wherein the feature to urge a user includes a cavity extending into a top surface of the first support surface, the cavity disposed adjacent a rear edge of the first support surface.

5. The seating configuration of claim 1, wherein the feature to urge a user includes a sloped surface to urge the user into the optimal position.

6. The seating configuration of claim 1, wherein the feature to urge a user is configured such that a peak pressure experienced by the user is below 100 mmHg.

7. The seating configuration of claim 1, wherein the second support surface is adjustable in a forward and backward direction to adjust a usable depth of the seating configuration, is height adjustable, and is pivotably adjustable.

8. The seating configuration of claim 1, wherein the third support surface is adjustable in a forward and backward direction, is height adjustable, and is pivotably adjustable.

9. A seating configuration comprising:

a first support surface configured to support Ischial Tuberosities of a user, the first support surface having a feature to urge the user into an optimal position on the first support surface;

a second support surface configured to support a pelvic-sacral-lumbar region of the user, the second support surface comprising:

a central portion having respective side edges, the central portion being thicker than the respective side edges; and a curved profile having an inward curve toward respective side edges and a gradual angle upward curve; and a third support surface configured to support a thoracic-cervical region of the user, the third support surface having a feature to promote lateral stability of the thoracic-cervical region of the user, wherein, in an operational setting, the first support surface provides counteracting support to the respective second and third support surfaces such that the first, second, and third support surfaces, respectively, together can be configured to establish a natural alignment of a spinal column of the user.

10. The seating configuration of claim 9, wherein the feature to urge a user includes a cavity extending into a top surface of the first support surface, the cavity disposed adjacent a rear edge of the first support surface.

11. The seating configuration of claim 10, wherein the feature to urge a user further includes a sloped surface to urge the user into the optimal position.

12. The seating configuration of claim 11, wherein the sloped surface travels along an incline plane extending from the cavity to a front edge of the first support surface.

13. The seating configuration of claim 9, wherein the second support surface includes contouring to support the pelvic-sacral-lumbar region of the user, and wherein the second support surface is adjustable in a forward and backward direction to adjust a usable depth of the seating configuration, is height adjustable, and is pivotably adjustable.

14. The seating configuration of claim 13, wherein the contouring of the second support surface includes an upward angled bias defined at least in part by a top edge having a first thickness and a bottom edge having a second thickness, the second thickness being greater than the first thickness.

15. The seating configuration of claim 9, wherein the third support surface includes contouring to support the thoracic-cervical region of the user, and wherein the third support surface is adjustable in a forward and backward direction, is height adjustable, and is pivotably adjustable.

16. A chair comprising:

a seat support surface having a feature to urge a user into an optimal position on the seat support surface, the feature defined in part by a cavity extending into a top surface of the seat support surface;

a pelvic-sacral-lumbar support surface positioned adjacent an expected location of a pelvic-sacral-lumbar region of the user, the pelvic-sacral-lumbar support surface comprising:

a central portion having respective side edges, the central portion being thicker than the respective side edges; and contouring to support the pelvic-sacral-lumbar region, the contouring defined at least in part by a curved profile having an inward curve toward respective side edges and a gradual angle upward curve; and a thoracic-cervical support surface positioned adjacent an expected location of a thoracic-cervical region of the user, the thoracic-cervical support surface comprising contouring to support the thoracic-cervical region and a feature to promote lateral stability of the thoracic-cervical region, wherein, in an operational setting, the seat support surface provides counteracting support to the respective pelvic-sacral-lumbar and thoracic-cervical support surfaces such that the seat, pelvic-sacral-lumbar, and thoracic-cervical support surfaces, respectively, together can be configured to establish a natural alignment of a spinal column of the user.

17. The chair of claim 16, wherein the pelvic-sacral-lumbar support surface is adjustable in a forward and backward direction to adjust a usable depth of the chair, is height adjustable, and is pivotably adjustable.

18. The chair of claim 17, wherein the thoracic-cervical support surface is adjustable in a forward and backward direction, is height adjustable, and is pivotably adjustable.

* * * * *